US010858079B2

(12) United States Patent
Rossi

(10) Patent No.: US 10,858,079 B2
(45) Date of Patent: Dec. 8, 2020

(54) VEHICLE FOR USE IN WATER, IN PARTICULAR INTO THE SEA

(71) Applicant: Crazy Dolphin S.r.L., Rome (IT)

(72) Inventor: Gianfranco Rossi, Rome (IT)

( * ) Notice: Subject to any disclaimer, the term of this patent is extended or adjusted under 35 U.S.C. 154(b) by 0 days.

(21) Appl. No.: 15/501,532

(22) PCT Filed: Aug. 3, 2015

(86) PCT No.: PCT/IB2015/055879
§ 371 (c)(1),
(2) Date: Feb. 3, 2017

(87) PCT Pub. No.: WO2016/020824
PCT Pub. Date: Feb. 11, 2016

(65) Prior Publication Data

US 2017/0225753 A1 Aug. 10, 2017

(30) Foreign Application Priority Data

Aug. 7, 2014 (IT) ..... RM2014A0466

(51) Int. Cl.

| | |
|---|---|
| ***B63B 34/10*** | (2020.01) |
| ***B63B 34/00*** | (2020.01) |
| ***B63H 16/00*** | (2006.01) |
| ***B63H 25/42*** | (2006.01) |
| ***B63B 7/04*** | (2020.01) |
| ***B63H 16/08*** | (2006.01) |

(52) U.S. Cl.
CPC ..... *B63B 34/10* (2020.02); *B63B 7/04* (2013.01); *B63B 34/00* (2020.02); *B63H 16/00* (2013.01); *B63H 16/14* (2013.01); *B63H 25/42* (2013.01)

(58) Field of Classification Search
CPC ..... B63H 16/00; B63H 16/14; B63H 16/20; B63B 34/00; B63B 34/10; B63B 32/00; A63B 35/00; A63B 35/10
USPC ..... 440/21, 25, 26, 27, 29, 30, 31, 32
See application file for complete search history.

(56) References Cited

U.S. PATENT DOCUMENTS

| | | | | | |
|---|---|---|---|---|---|
| 1,277,022 | A * | 8/1918 | Young | B63H 16/14 | 440/31 |
| 1,752,051 | A * | 3/1930 | Young | A63B 35/10 | 440/31 |
| 5,643,020 | A * | 7/1997 | Harris | B63H 16/14 | 440/31 |
| 6,309,263 | B1 * | 10/2001 | Mier-Maza | B63B 43/14 | 440/21 |
| 6,500,034 | B1 * | 12/2002 | Lau | B63H 16/14 | 440/21 |
| 6,533,621 | B1 * | 3/2003 | Yang | B63H 16/14 | 440/31 |

* cited by examiner

*Primary Examiner* — Lars A Olson

(57) ABSTRACT

The present invention relates to an improved vehicle for use in water, in particular into the sea. More specifically, the invention relates to the structure of a vehicle of type called configured to have a hydrodynamic profile and to allow a user to turn with greater speed.

14 Claims, 15 Drawing Sheets

VEHICLE FOR USE IN WATER, IN PARTICULAR INTO THE SEA

The present invention relates to an improved vehicle for use in water, in particular into the sea.

More specifically, the invention relates to the structure of a vehicle of the type called configured for having a hydrodynamic profile and allowing a user to turn with greater speed.

Currently, a vehicle is known for use in water by a user described in the patent application for utility model RM2010U000189 filed by the same Applicant.

Said vehicle comprises a floating board, substantially flat and having a front portion and a rear portion, opposite with each other, at least a screw propeller associated to said board, and actuating means of said at least a propeller configured to remain submerged when in use and be actuated by the user's feet.

In particular, said vehicle comprises steering means, obtained on the front portion of the board, apt to control the motion of a rudder associated to said steering means, which is positioned below said steering means.

A disadvantage of said vehicle of known type is that it has not a particularly hydrodynamic profile.

A second disadvantage is given by the fact that it is not capable of turning quickly.

The object of the present invention is to overcome said disadvantages, by providing a vehicle for use in water, simple and with low cost, with a hydrodynamic profile and able to allow the user to turn quickly on the right and on the left.

An additional object is to allow a more effective turning than a traditional turning.

This has been obtained with a vehicle for use in water configured so as to have a board limited in the sizes and a rudder for each screw propeller.

Therefore the subject of the invention is a vehicle for use in water according to claim 1.

Additional embodiments are described in the depending claims.

The present invention will be now described, by way of illustration, but not for limitative purposes, according to embodiments thereof, with particular reference to the enclosed figures, wherein.

Figure 1:
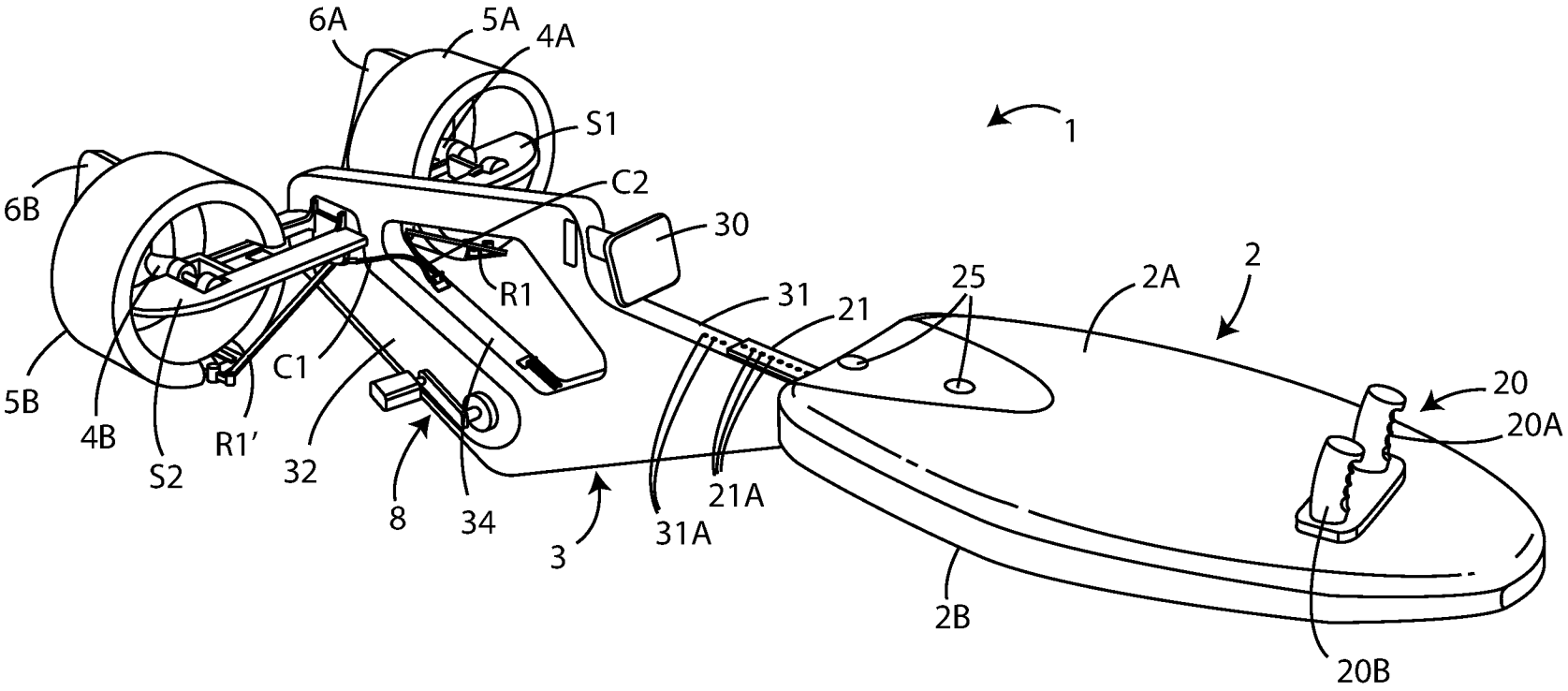
FIG. 1 is a perspective view of a first embodiment of the vehicle for use in water.
Figure 2A:
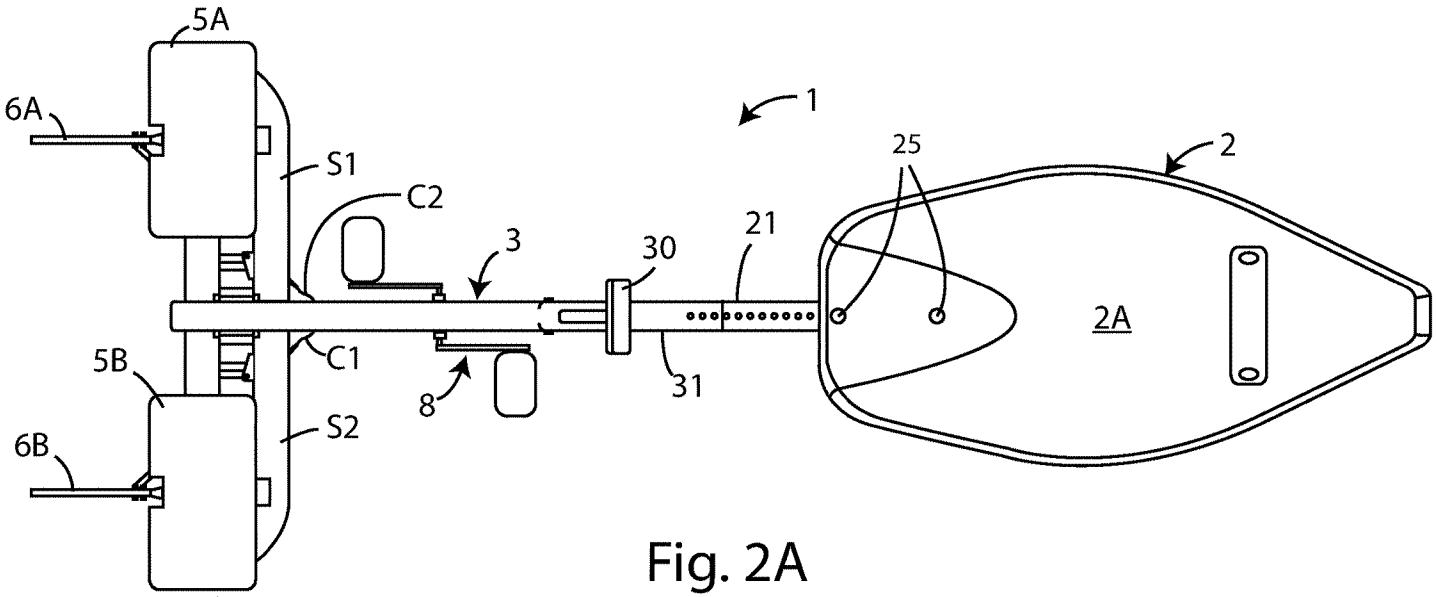
FIGS. 2A-2B show a view respectively from the top and the bottom of the vehicle of FIG. 1.
Figure 2B:
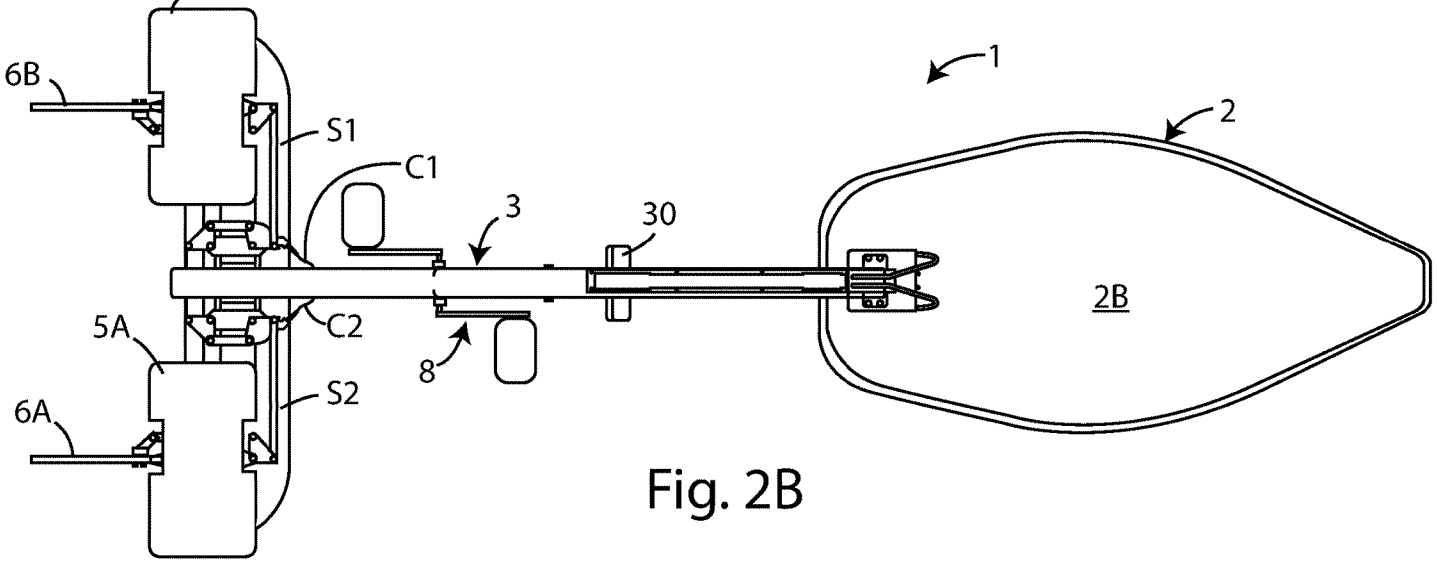
Figure 3B:
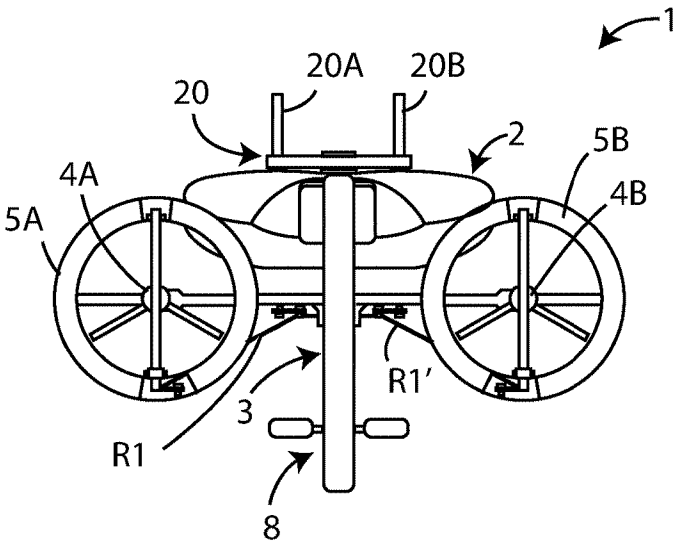
FIG. 3A-3B show a front view and a rear view, respectively, of the vehicle of FIG. 1.
Figure 3A:
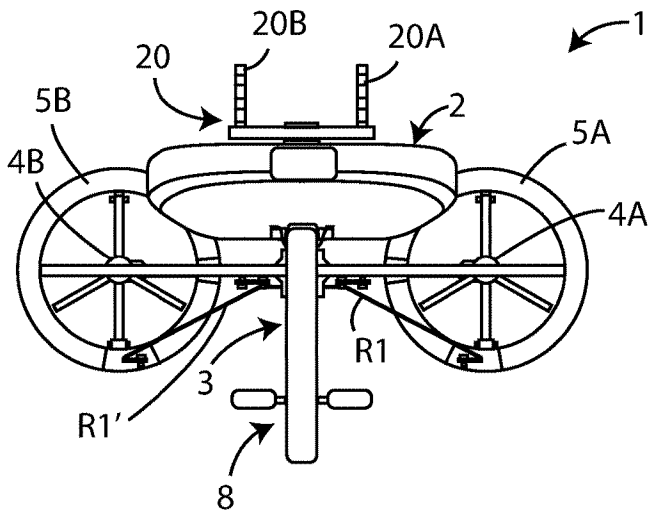
Figure 4:
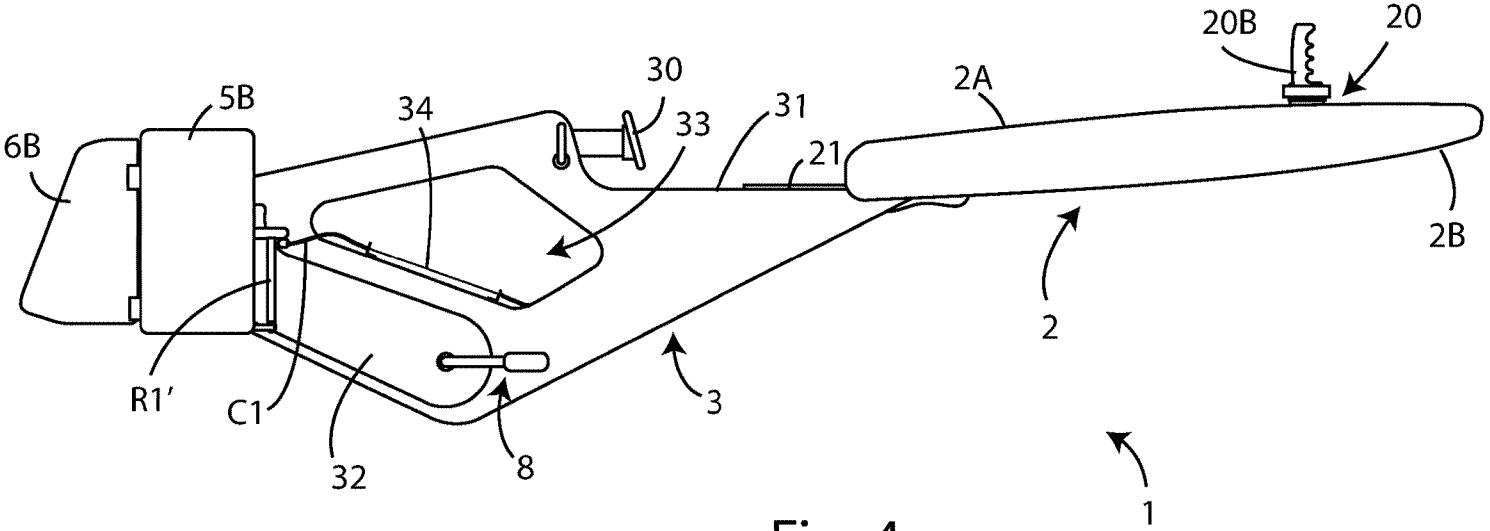
FIG. 4 shows a side view of the vehicle of FIG. 1.

With particular reference to FIG. 1-4, the first embodiment of a vehicle for use in water by a user is described.

Said vehicle 1 comprises:

a floating board 2, and a substantially flat tail component 3, fitted with a resting element 30 for allowing a user to rest his/her bottom.

In particular, the board 2 is shaped and configured to allow a user to rest substantially only his/her breast. Furthermore, said board 2 comprises a first surface 2A, which is useful as supporting element for a user, and a second surface 2B, opposite to said first surface, and said tail component 3 comprises two screw propellers, a first screw propeller 4A and a second screw propeller 4B, as well as actuating means 8 for actuating said screw propellers 4A, 4B.

Said actuating means 8 comprises two pedals. The push thrust of the user actuates the screw propellers. Said two pedals are arranged on the tail component 3 so as to remain submerged in water when the vehicle is in use.

The pedals are associated to the pair of screw propellers by means of a transmission system of the type with gears.

Figure 5:
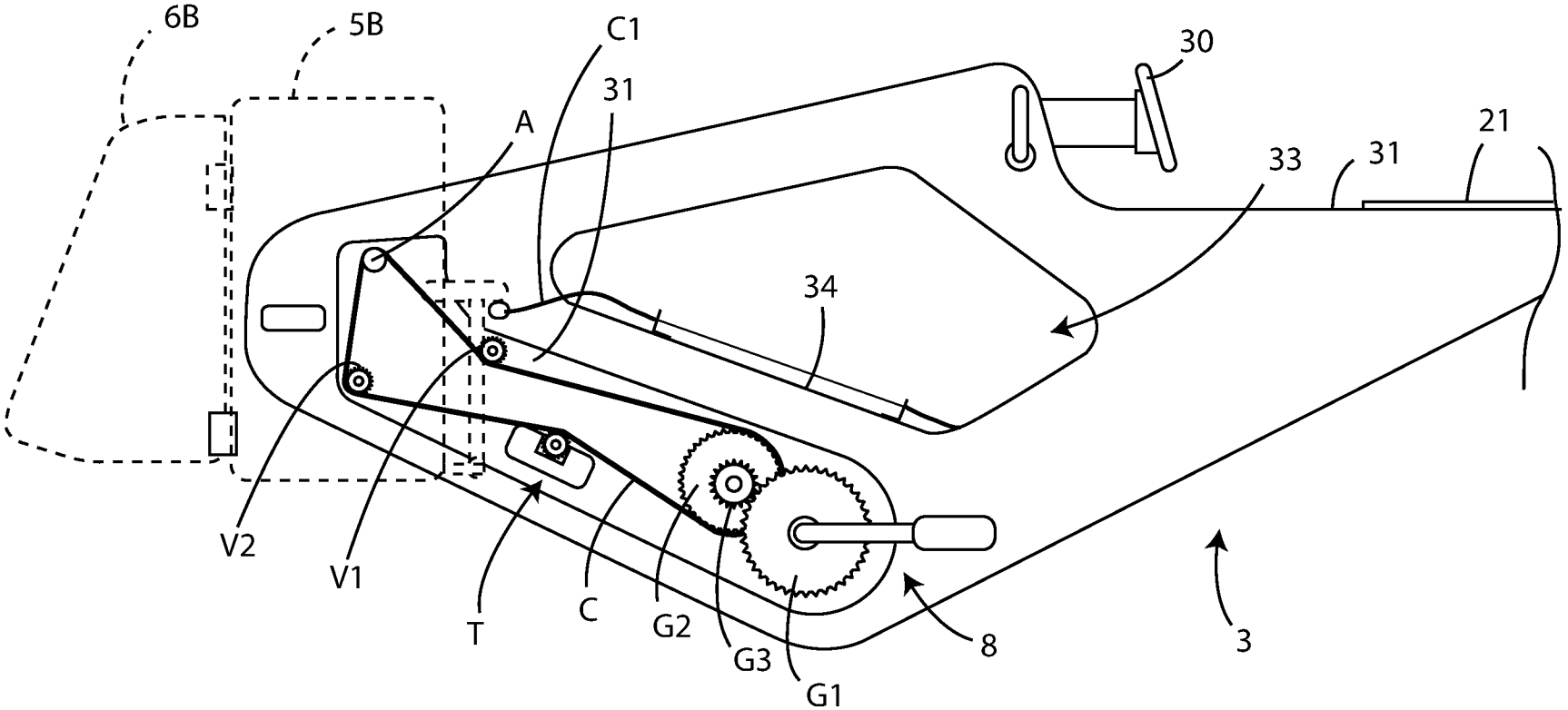
FIG. 5 shows a detail related to the kinematic mechanism therewith the screw propellers of the vehicle of FIG. 1 are actuated.

Said transmission system is arranged inside an opening 31 obtained in the tail component 3 and sealingly closed by a door 32 (FIG. 5).

In particular, said transmission system comprises a driving gear wheel G1, associated to the pair of pedals, apt to be set in motion by said pedals, a toothed pulley G2, coupled to said driving gear wheel G1 by means of a driven gear wheel G3, so that the motion is transferred by said driving gear wheel G1 to said toothed pulley G2 by means of said driven gear wheel G3. The transmission system further comprises a toothed belt C allowing to transfer the motion from said toothed pulley G2 to a transmission shaft A rotating on its own axis. Said transmission axis A is arranged within a respective support bracket S1, S2 for supporting the screw propellers and at the ends thereof it comprises a respective gear (not shown in the figures) for cooperating with a respective gear (not shown in the figures) obtained on an inner portion of each screw propeller 4A, 4B. In fact, said screw propellers are arranged on a respective support bracket S1,S2, symmetrically with respect to the tail component 3. Each one of said support brackets S1,S2 is connected integrally to the tail component 3.

Each gear arranged at the end of the transmission shaft A capable of cooperating with the respective gear of each screw propeller 4A, 4B can be configured by means of a coupling of conical type.

In particular, the transmission system further comprises a first idler roll V1 and a second idler roll V2, as well as a tensioning device T to keep in tension said toothed belt C.

By referring to the screw propellers, each screw propeller 4A, 4B is inserted in a respective carter 5A, 5B, outside the tail component and configured so as to transmit a floating effect to the tail component 3. To this purpose, each carter 5A, 5B has a toroidal shape.

According to a peculiar feature of the invention, a respective rudder 6A, 6B is associated to each screw propeller 4A, 4B, which rudder being steerable with respect to the direction of advancement of the vehicle. Consequently, a first rudder 6A is associated to the first screw propeller 4A and a second rudder 6B is associated to the second screw propeller.

Each rudder 6A, 6B is coupled to a respective carter 5A, 5B and it is capable of rotating by an angle comprised between 0° and 180° with respect to the carter.

The rudders 6A, 6B associated to the respective screw propellers 6A, 6B are controlled by steering means 20 arranged on said board 2.

Said steering means 20 comprises a first control lever 20A and a second control lever 20B, to each one thereof a first cable C1 and a second cable C2 is respectively associated. The first cable C1 and the second cable C2 extend through the board 2 ant the tail component 3 as far as a motion system of the rudders arranged on a surface of the support brackets S.

Figure 6B:
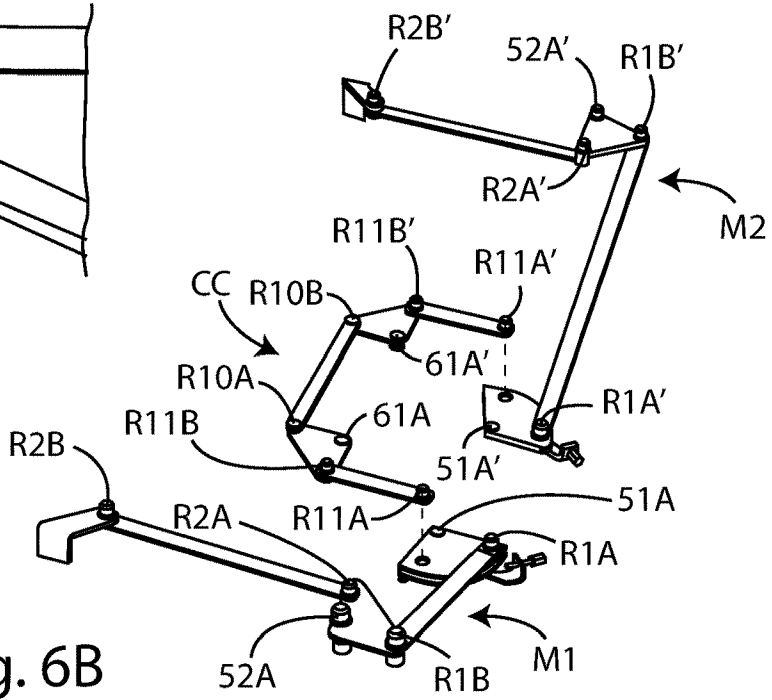
FIG. 6B is an exploded view of the motion system for moving the rudders of the vehicle, comprising two motion mechanisms connected therebetween by a connecting kinematic mechanism.
Figure 6A:
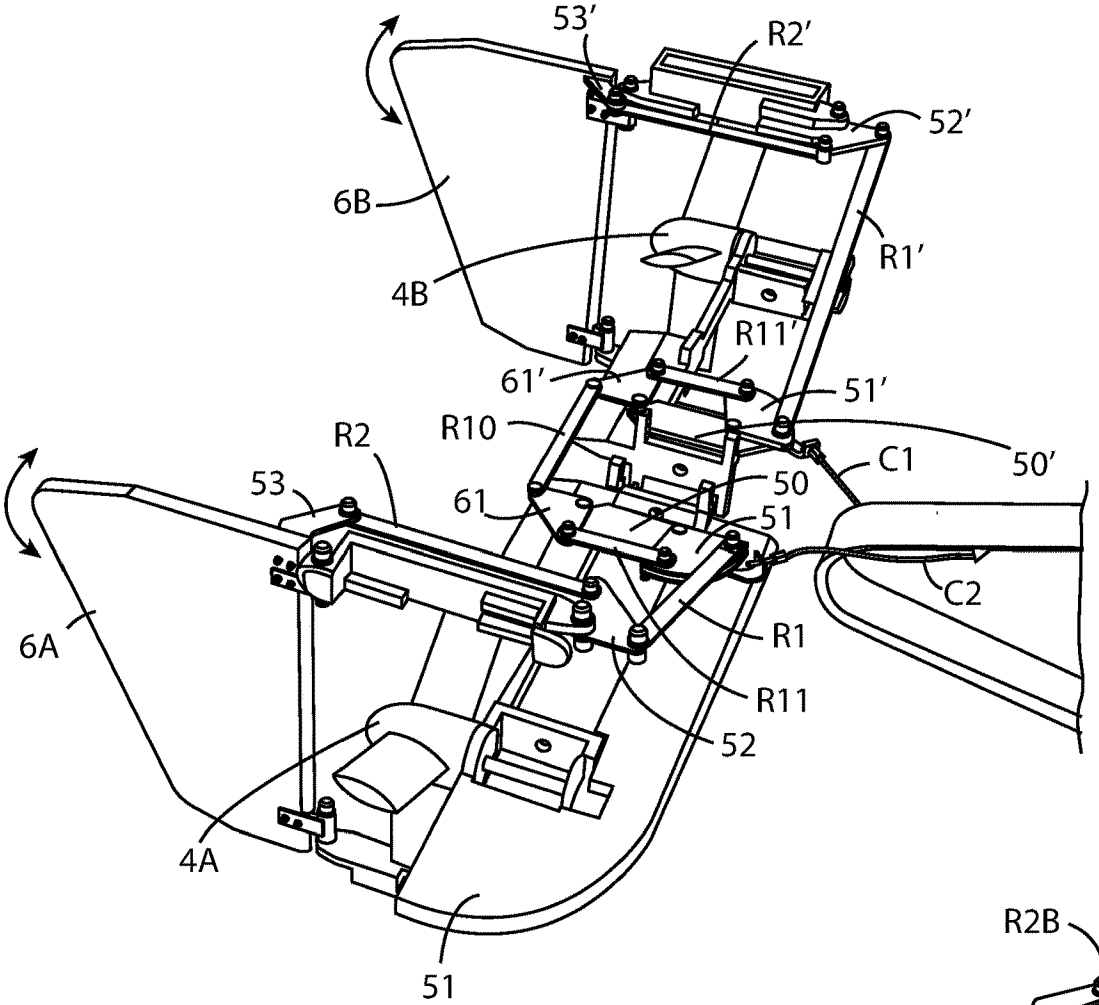
FIG. 6A shows a portion of the overturned vehicle thereto the motion system is associated for moving the rudders of the vehicle, associated to the screw propellers.

By particularly referring to FIGS. 6A,6B the kinematic mechanism is described therewith the steering means 20 controls the screw propellers.

The motion system of the rudders is of mechanical type and it is configured for moving both rudders 6A, 6B in the same direction and with the same angle with respect to the carter thereto each one thereof is associated.

As shown in FIGS. 6A,6B, the motion system of the rudders comprises a first mechanism M1 for moving said first rudder 6A, associated to the first support bracket S1, and a second mechanism M2 for moving said second rudder 6B, associated to the second support bracket S2, connected therebetween by a connecting kinematic mechanism CC so that:

when the first mechanism M1 moves said first rudder 6A in a first direction, said second mechanism M2 is set in motion by said first mechanism Ml, by means of said connecting kinematic mechanism CC, and moves said second rudder 6B in the same direction of said first rudder 6A, and when the second mechanism M2 moves said second rudder 6B in a second direction, opposite to said first direction, said first mechanism M1 is set in motion by said second mechanism M2, by means of said connecting kinematic mechanism CC, and moves said first rudder 6A in the same direction of said second rudder 6B.

In particular, each mechanism M1, M2 respectively comprises:

a first element 51,51', thereto a cable C2,C1 is coupled, wherein said first element 51,51' is rotatably pivoted on a plate 50,50' by means of a first pin 51A,51A', and wherein said plate 50,50' is coupled to a support bracket S1, S2, a second element 52,52' rotatably pivoted on a support bracket 51,52 by a second pin 52A,52A', a first connecting rod R1,R1' for rotatably connecting the first element 51,51' to the second element 52,52', so that, when the first element 51,51' rotates in a direction, the second element 52,52' rotates in the same direction of said first element 51,51' by means of said first connecting rod R1,R1', a second connecting rod R2,R2' for rotatably connecting the second element 52,52' to a bracket 53,53' integral to a rudder 6A,6B, so that, when said second element 52,52' rotates, said rudder 6A, 6B rotates by a predetermined angle in the same direction of said first element 51,51'.

In other words, when the first mechanism M1 for moving said first rudder 6A is actuated by the second cable C2, associated to the second control lever 20B, as said second cable C2 is connected to the first element 51 of the first mechanism M1, the second mechanism M2 is actuated by the first mechanism M1 by means of the connecting kinematic mechanism.

When the second mechanism M2 for moving said second rudder 6B is actuated by the first cable C1, associated to the first control lever 20A, as said first cable C1 is connected to the first element 51' of the second mechanism M2, the first mechanism M1 is actuated by the second mechanism M2 by means of the connecting kinematic mechanism.

In order to avoid the interference between the two cables C1, C2, the vehicle is fitted with a pulley 24 having at least a (not shown) groove for housing a portion of a respective cable. Thanks to said at least a groove, the cables C1,C2 can be crossed, without interfering with each other.

By referring to the first mechanism M1 for moving said first rudder 6A, the first connecting rod R1 is pivoted on the first element 51 and on the second element 52 by means of a respective pin R1A,R1B, and the second connecting rod R2 is pivoted on the second element 52 and on the bracket 53 by means of a respective pin R2A,R2B.

By referring to the second mechanism M2 for moving said second rudder 6B, the first connecting rod R1' is pivoted on the first element 51' and on the second element 52' by means of a respective pin R1A',R1B', and the second connecting rod R2' is pivoted on the second element 52' and on the bracket 53' by means of a respective pin R2A', R2B'.

The connecting kinematic mechanism CC comprises:

a first element 61 rotatably pivoted on the plate 50 of the first mechanism M1 by a pin 61A, a second element 61' rotatably pivoted on the plate 50' of the second mechanism M2 by a pin 61A', a first connecting rod R11 for rotatably connecting said first element 61 of said connecting kinematic mechanism CC to said first element 51 of said first mechanism M1, a second connecting rod R11' for rotatably connecting said second element 61' of said connecting kinematic mechanism CC to said first element 51' of said second mechanism M2, and a third connecting rod R10 for rotatably connecting said first element 61 of said connecting kinematic mechanism CC to said second element 61' of said connecting kinematic mechanism CC.

Thanks to said connecting kinematic mechanism CC, when the first mechanism M1 is set in motion by the steering means 20, said second mechanism M2 is set in motion by said first mechanism M1 and viceversa.

In particular, by referring to the connecting kinematic mechanism CC, the first connecting rod R11 is pivoted on the first element 51 of the first mechanism M1 and on the first element 61 of the connecting kinematic mechanism CC by means of a respective pin R11A,R11B, and the second connecting rod R11' is pivoted on the first element 51' of the second mechanism M2 and on the second element 61' of the connecting kinematic mechanism CC by means of a respective pin R11A',R11B'. Furthermore, the third connecting rod R10 is pivoted on the first element 61 and on the second element 61' of the connecting kinematic mechanism CC by means of a respective pin R10A,R10B.

Figure 7A:
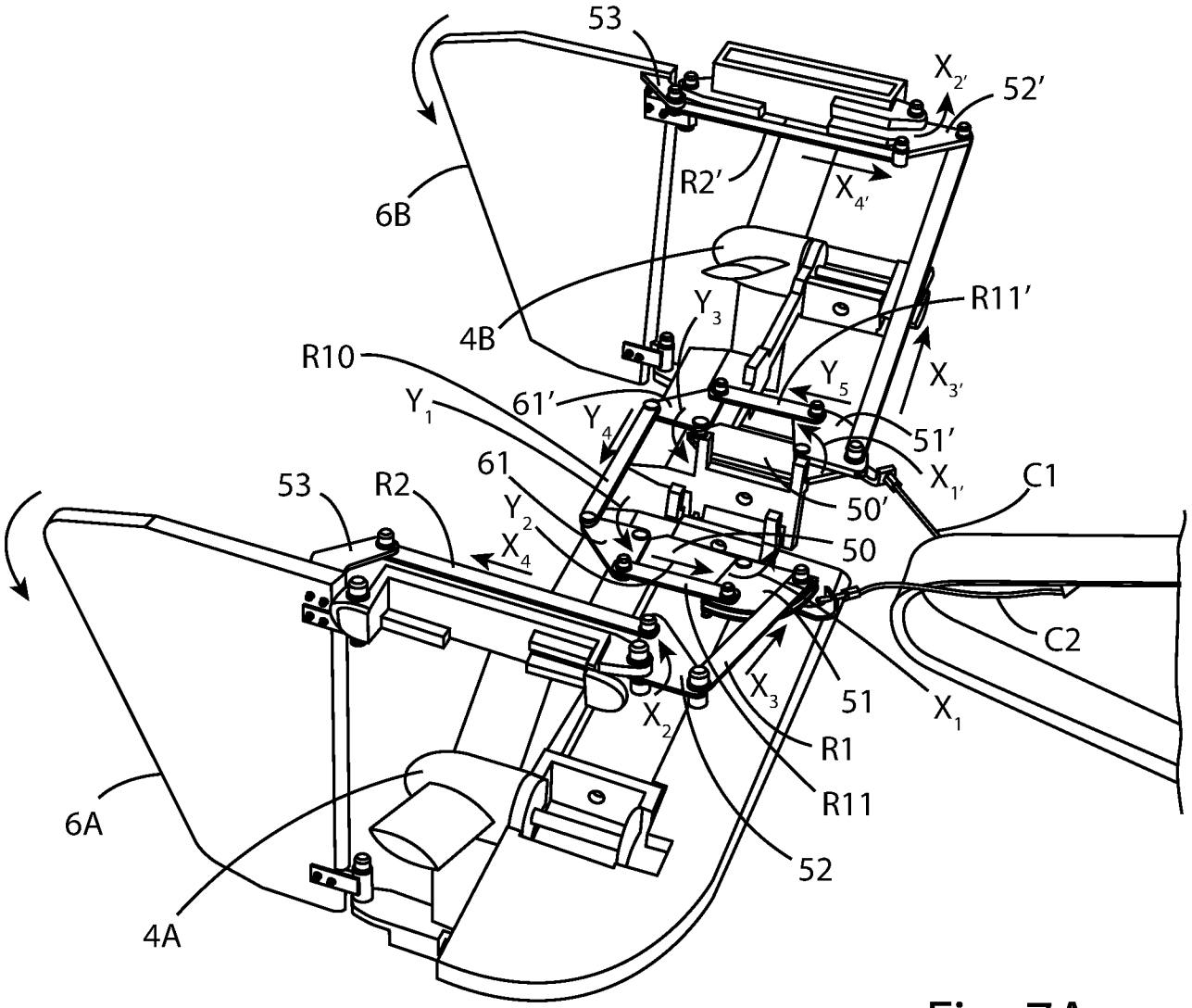
FIG. 7A shows a portion of the overturned vehicle thereto the motion system of the rudders is associated, when both of them are rotated in a first direction so that vehicle turns on the left.
Figure 7B:
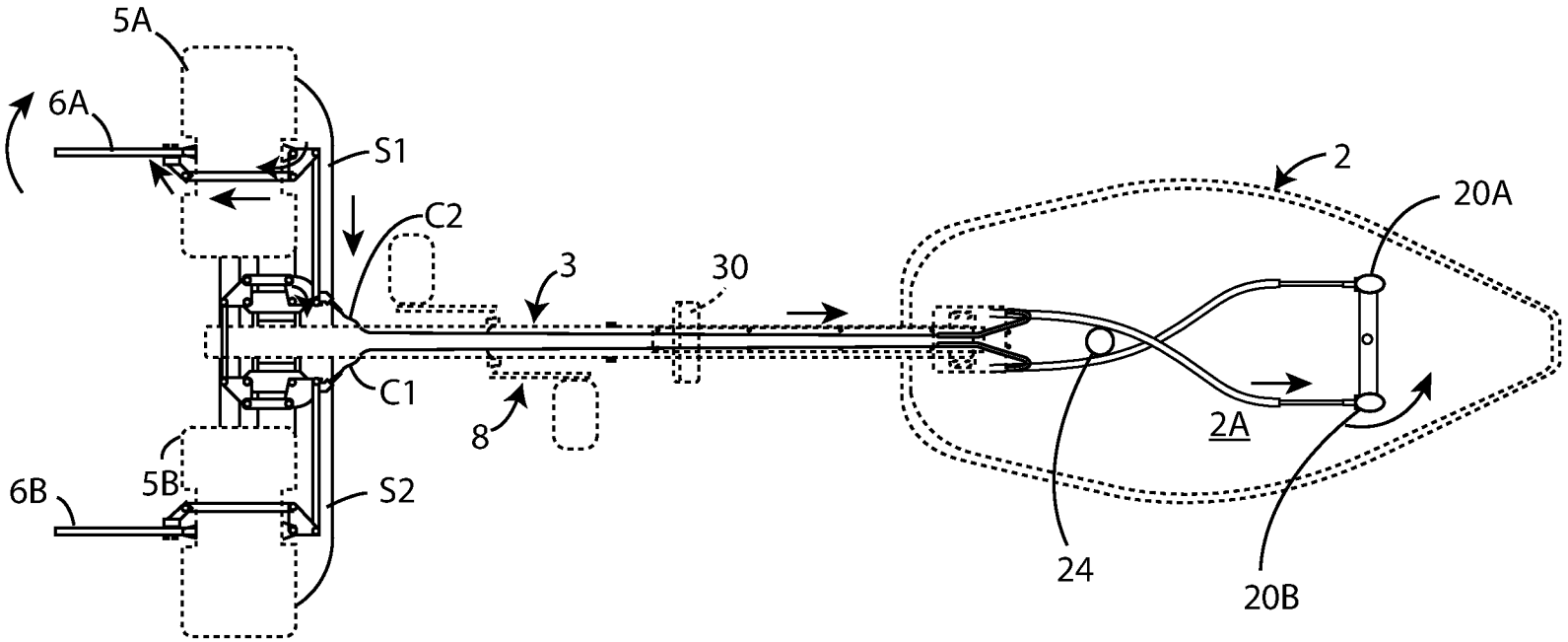
FIG. 7B is a top view of the motion system of the rudders when both ones are rotated in a first direction so that the vehicles turns on the left.

FIGS. 7A and 7B show the operation of the transmission system for moving the rudders when both rudders 6A, 6B are rotated in a first direction and the vehicle turns on the left.

When the second control lever 20B is rotated by a user, the second cable C2, associated thereto, acts on the first element 51 of the first mechanism M1 (since said second cable C1 is coupled to said first element 51) by making it to rotate according to the arrow X1. The rotation of said first element 51 puts into rotation the second element 52 of the first mechanism M1 according to the arrow X2 by means of the motion of the first connecting rod R1 of the first mechanism M1 according to the arrow $X_3$. The rotation of the second element 52 of the first mechanism M1 puts in rotation the first rudder 6A by means of the motion of the second connecting rod R2 of the first mechanism according to the arrow $X_4$.

Furthermore, as the first element 51 of the first mechanism M1 is connected to the first element 51' of the second mechanism M2 by means of the connecting kinematic mechanism CC, said first element 51' of the second mechanism M2 rotates according to the arrow $X_{1'}$. The rotation of said first element 51' puts in rotation the second element 52' of the second mechanism M2 according to the arrow $X_{2'}$ by means of the motion of the first connecting rod R1' of the second mechanism M2 according to the arrow $X_{3'}$. The rotation del second element 52' of the second mechanism M2 puts in rotation the second rudder 6B by means of the motion of the second connecting rod R2' of the second mechanism M2 according to the arrow $X_{4'}$.

As far as the connecting kinematic mechanism CC is concerned, the first element 61 of the connecting kinematic mechanism CC is put into rotation according to the arrow $Y_1$ by the first element 51 of the first mechanism M1 by means of the motion of the first connecting rod R11 of the connecting kinematic mechanism CC according to the arrow $Y_2$ and the second element 61' of the connecting kinematic mechanism CC is put into rotation according to the arrow $Y_3$ by the first element 61 of the same connecting kinematic mechanism CC by means of the motion of the third connecting rod R10 of said connecting kinematic mechanism according to the arrow $Y_4$. In particular, the first connecting rod R11 of the connecting kinematic mechanism CC is moved by the rotation of the first element 51 of the first mechanism M1, whereas the first element 51' of the second mechanism M2 is put into rotation by the motion of the second connecting rod R11' of the connecting kinematic mechanism CC according to the arrow $Y_5$.

Figure 8A:
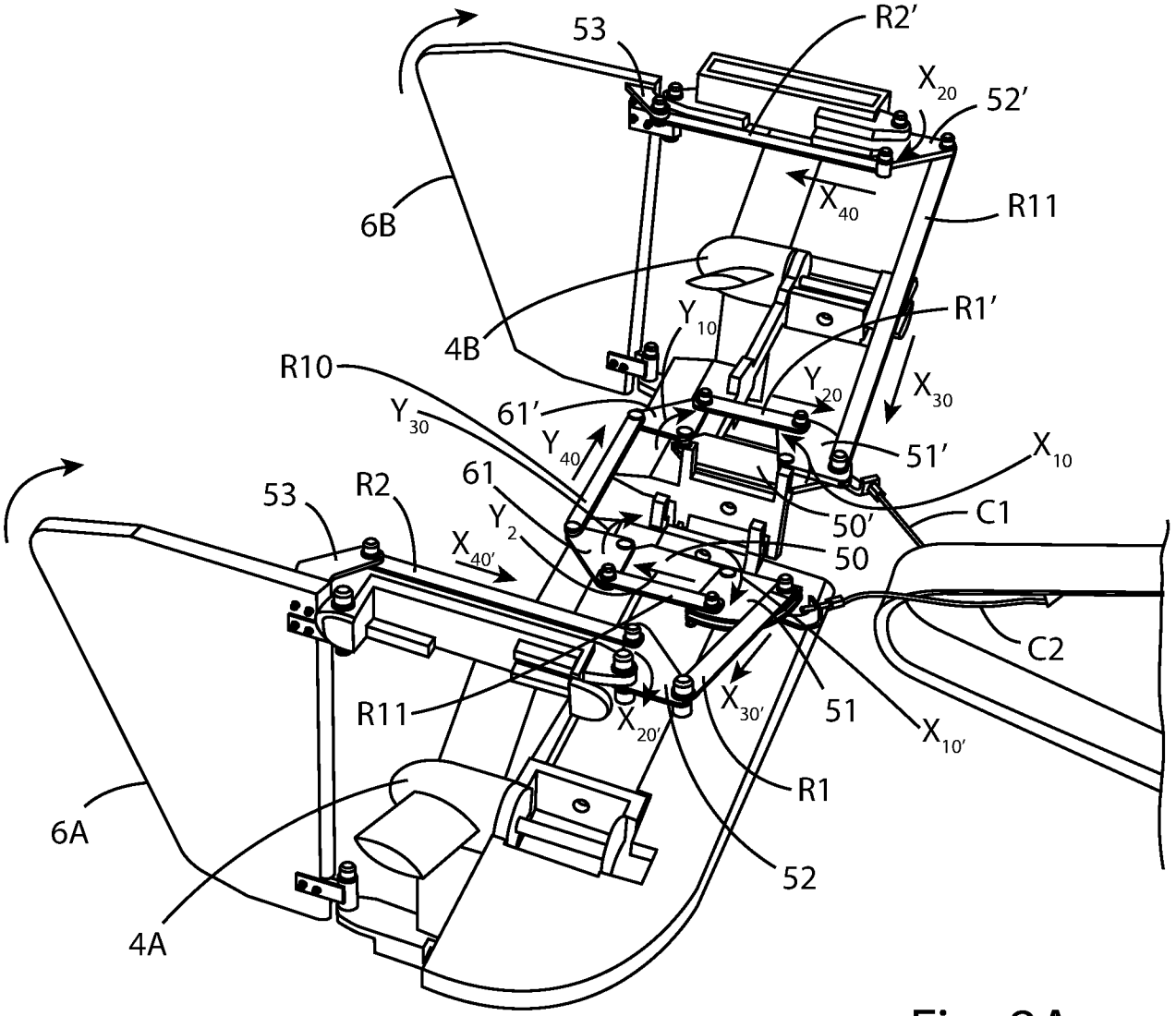
FIG. 8A is a view of a portion of the overturned vehicle thereto the motion system of the rudders is associated when they are rotated in a second direction so that the vehicle turns on the right.
Figure 8B:
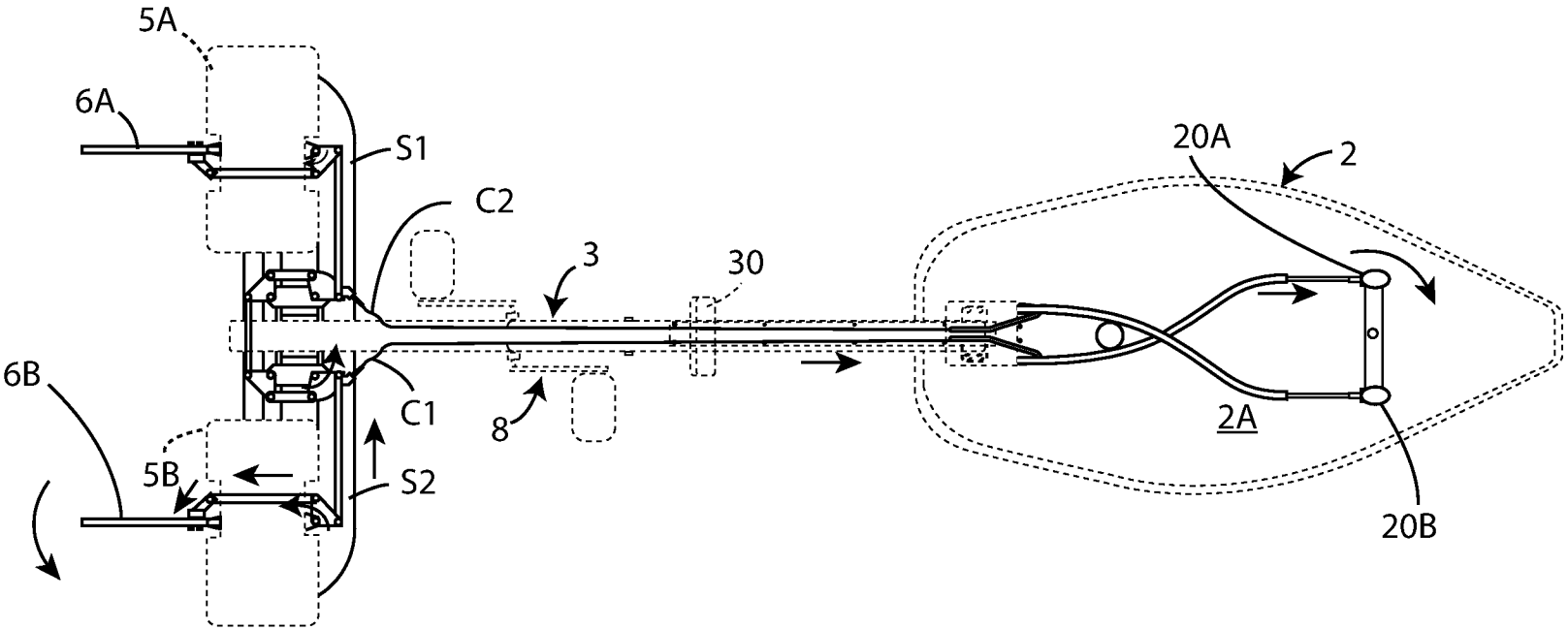
FIG. 8B shows a top view of the motion system of the rudders when both of them are rotated in a second direction so that the vehicle turns on the right.

FIGS. 8A and 8B show the operation of the motion system of the rudders when both rudders 6A, 6B are rotated in a second direction, opposite to said first direction, and the vehicle turns on the right.

When the first control lever 20A is rotated by a user, the first cable C1, associated thereto, acts on the first element 51' of the second mechanism M2 (as said first cable C1 is coupled to said second element 51') by making it to rotate according to the arrow $X_{10}$. The rotation of said first element 51' puts in rotation the second element 52' of the second mechanism M2 according to the arrow $X_{20}$ by means of the motion of the first connecting rod R1' of the second mechanism M2 according to the arrow $X_{30}$. The rotation of the second element 52' of the second mechanism M2 puts in rotation the second rudder 6B by means of the motion of the second connecting rod R2' of the second mechanism M2 according to the arrow $X_{40}$.

Furthermore, as the first element 51' of the second mechanism M2 is connected to the first element 51 of the first mechanism M1 by means of the connecting kinematic mechanism CC, said first element 51 of the first mechanism M1 rotates according to the arrow $X_{10'}$. The rotation of said first element 51 puts in rotation the second element 52 of the first mechanism M1 according to the arrow $X_{20'}$ by means of the motion of the first connecting rod R1 of the first mechanism M1 according to the arrow $X_{30'}$. The rotation of the second element 52 of the first mechanism M1 puts in rotation the first rudder 6A by means of the motion of the second connecting rod R2 of the first mechanism M1 according to the arrow $X_{40'}$.

As far as the the connecting kinematic mechanism CC is concerned, the second element 61' of the connecting kinematic mechanism CC is put into rotation according to the arrow $Y_{10}$ by the first element 51' of the second mechanism M2 by means of the motion of the second connecting rod R11' of the connecting kinematic mechanism CC according to the arrow $Y_{20}$ and the first element 61 of the connecting kinematic mechanism CC is put into rotation according to the arrow $Y_{30}$ by the second element 61' of the same connecting kinematic mechanism CC by means of the motion of the third connecting rod R10 of said connecting kinematic mechanism according to the arrow $Y_{40}$.

Advantageously, said board 2 is removably coupled with said tail component 3, so as to reduce the encumbrance and to facilitate the transportation. In particular, said board 2 is slidingly coupled to said tail component 3, so that a user can adjust the distance between the steering means 20 and the resting element 30 based upon the height thereof and/or the needs thereof.

In the first embodiment which is described, the board 2 is fitted with two through holes 25 for allowing the passage of a respective (not shown) coupling element, such as for example a pin or a screw, for coupling said board 2 to said tail component 3.

In particular, both the board 2 and the tail component 3 comprise a respective elongated portion 21, 31 (projecting with respect to the board 2 and to the tail component 3) fitted with a plurality of holes 21A, 31A spaced apart therebetween. In particular, said elongated portion 21 of said board 2 and said elongated portion 31 of said tail component 3 are sized and configured to be overlapped, at least partially, so that one or more holes 21A of the elongated portion 21 of the board 2 overlap to a respective hole 31A of the elongated portion 31 of the tail component 3. The through holes 25 provided on the board 2 are arranged so as to overlap to respective holes 21A of the elongated portion 21 so as to allow the passage of said coupling elements for coupling said board 2 to said tail component 3.

Furthermore, in the first embodiment which is described, said tail component 3 has a through opening 33 defined by an edge 34. Said through opening 33 has the shape of a quadrilateral with the rounded angles.

Figure 9A:
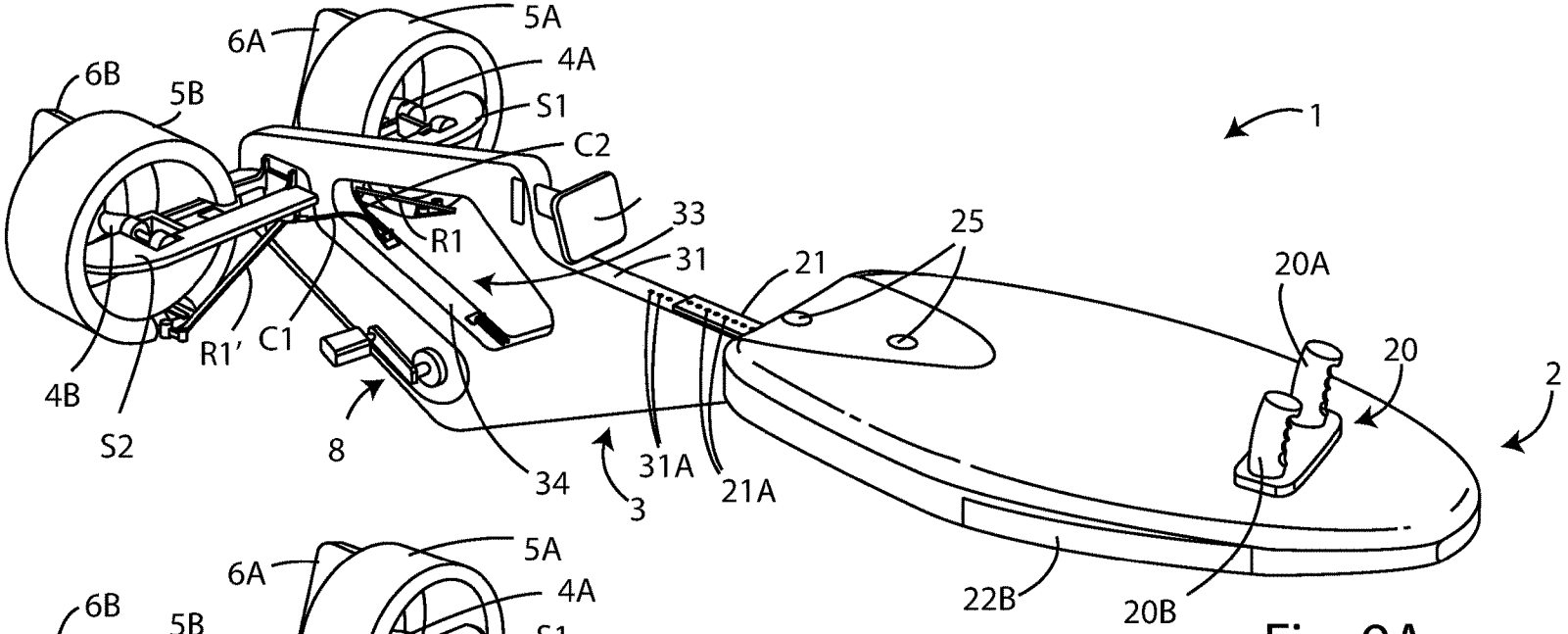
FIGS. 9A and 9B show a second embodiment of the vehicle for use in water comprising a pair of stabilizing elements, respectively in closed and open position.
Figure 9B:
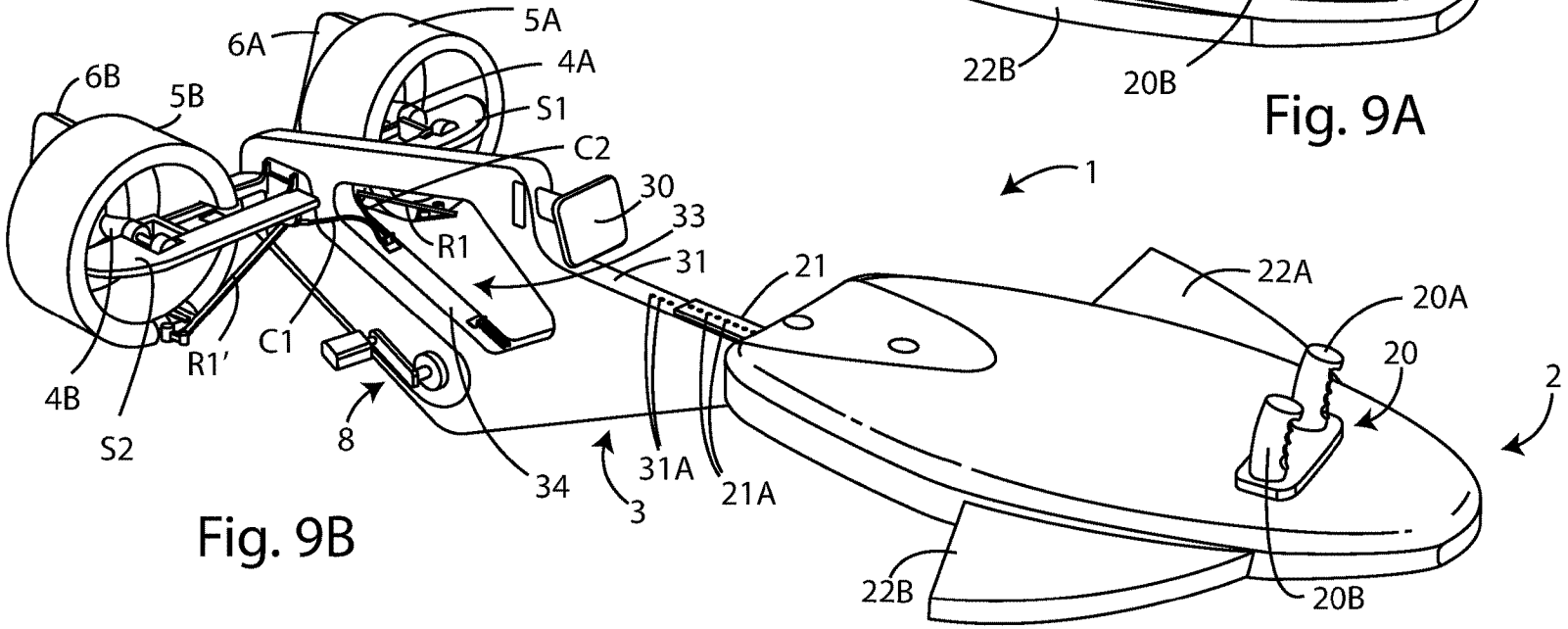

FIGS. 9A and 9B show a second embodiment of the vehicle for use in water.

Differently from the first embodiment, said vehicle 1 comprises a pair of stabilizing elements 22A and 22B so that said vehicle has a greater stability in water.

Each one of said stabilizing elements is obtained in the board 2 and it is capable of passing from a first closed position, wherein each stabilizing element is inside the board 2, and a second open position, wherein each stabilizing element is external to the board and projects sideways relative thereto.

FIG. 9A shows both stabilizing elements in the first closed position, whereas FIG. 9B shows both stabilizing elements in the second open position.

Figure 10A:
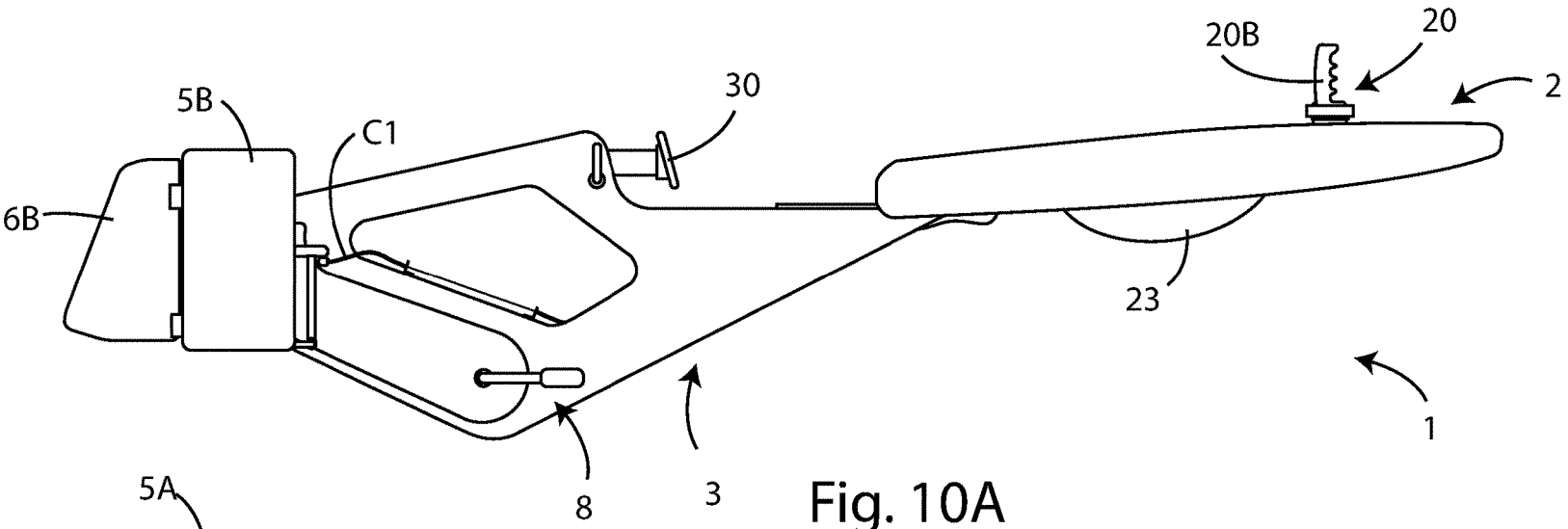
FIGS. 10A and 10B show a side view and a bottom view, respectively. of a third embodiment of the vehicle for use in water.
Figure 10B:
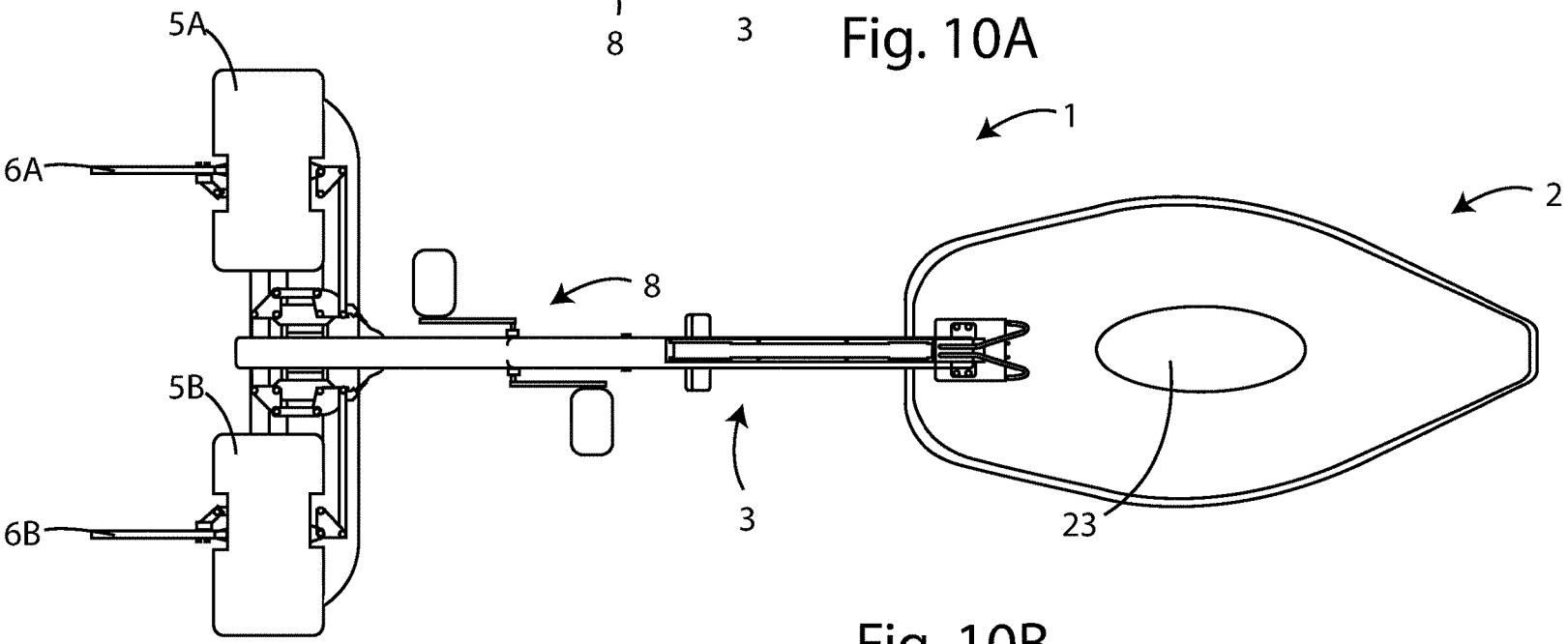

FIGS. 10A and 10B show a third embodiment of the vehicle for use in water.

Differently from the first embodiment, the board 2 is fitted with a floating element 23, arranged below said board, for giving greater buoyancy to the board itself, so that said board 2 remains as much as possible on the water surface, by eliminating the frictions due to the water viscosity.

In other words, said floating element 23 is coupled to the second surface 2B of the board 2, and it exerts a floating force on said board 2, when said vehicle 1 is in use in water.

Figure 11:
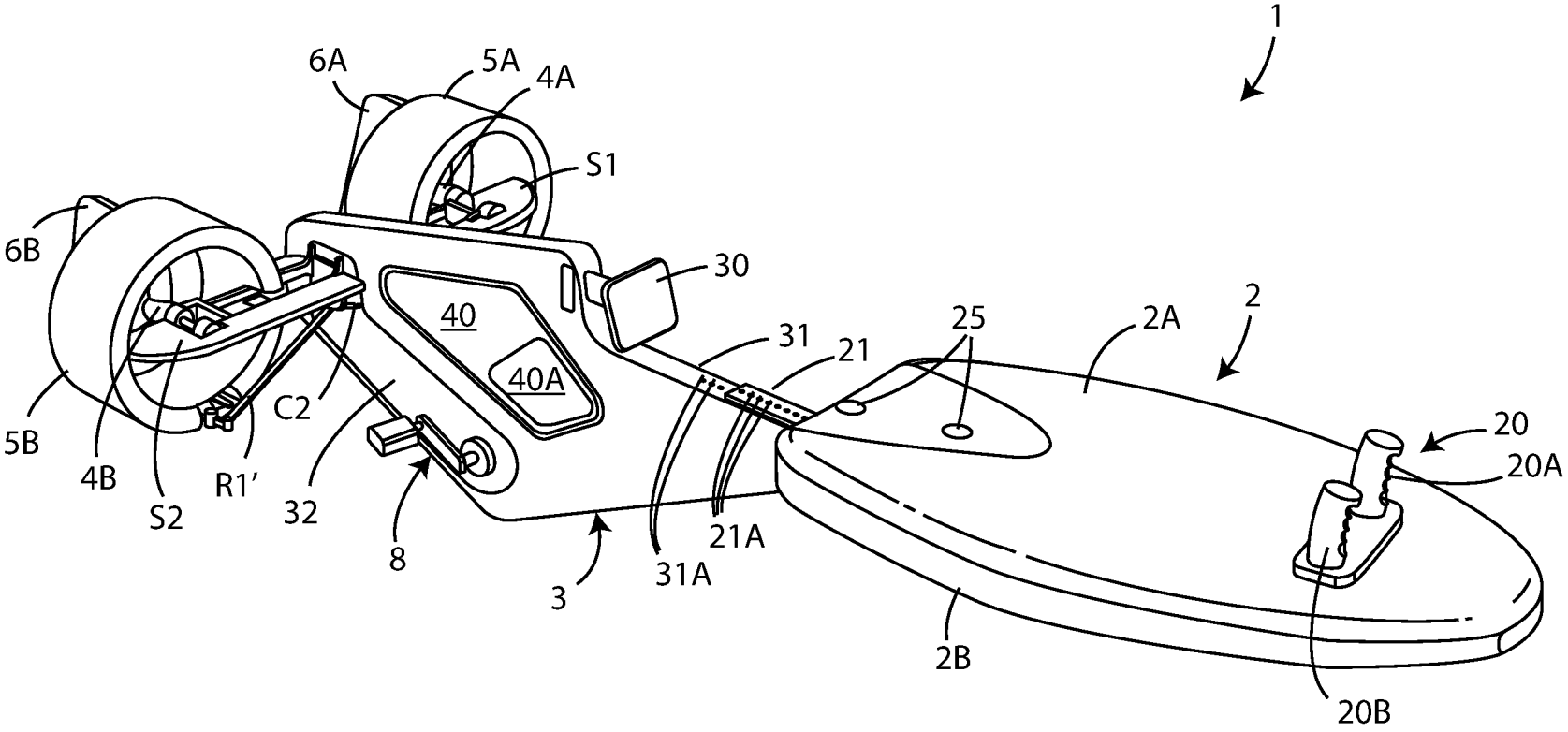
FIG. 11 shows a fourth embodiment of the vehicle for use in water.
Figure 12:
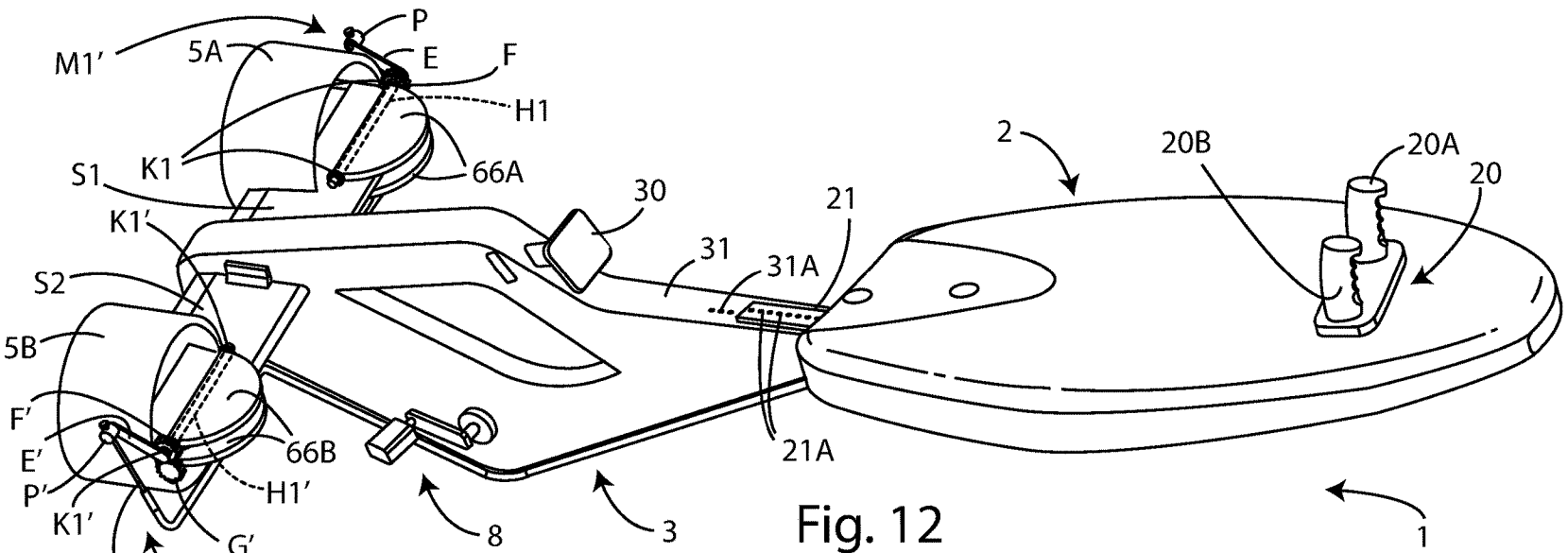
FIG. 12 shows a fifth embodiment of the vehicle for use in water, with two pairs of fins, respectively associated to a screw propeller, in opening position.
Figure 13:
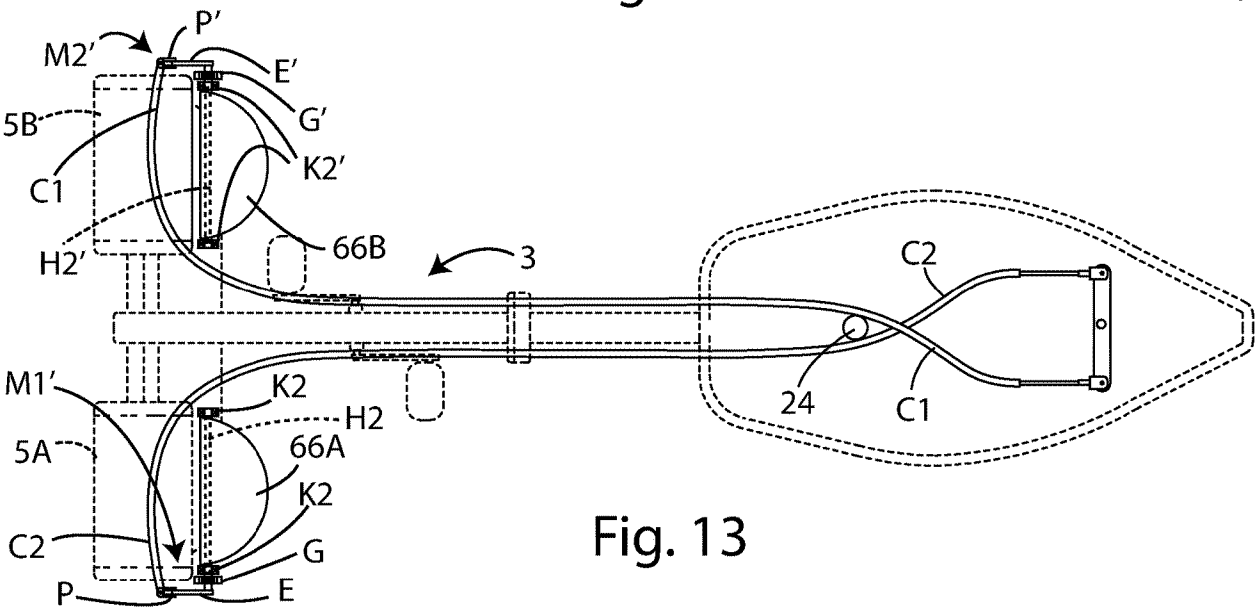
FIG. 13 shows a bottom view of the vehicle of FIG. 12.
Figure 14A:
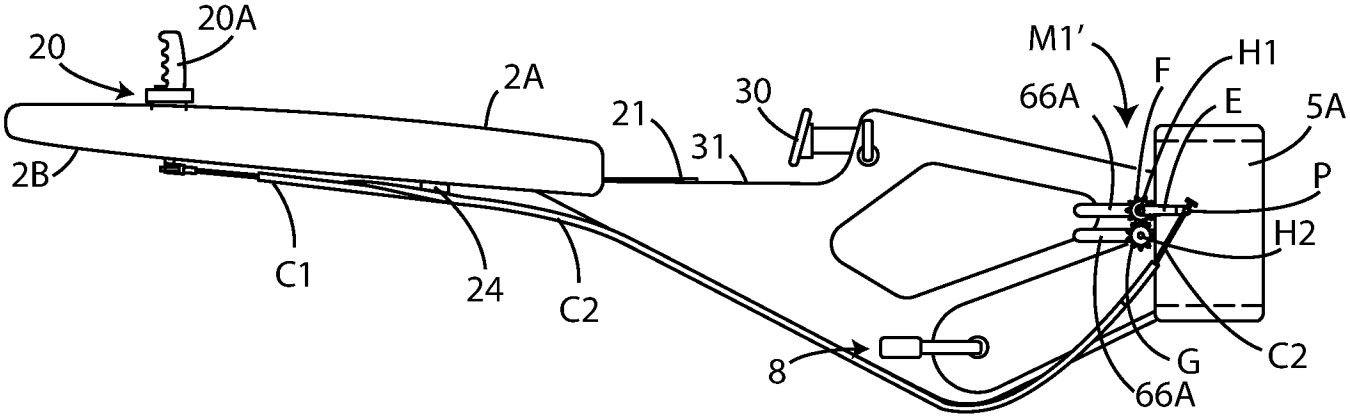
FIGS. 14A, 14B show a first side view and a second side view, respectively, of the vehicle of FIG. 12.
Figure 14B:
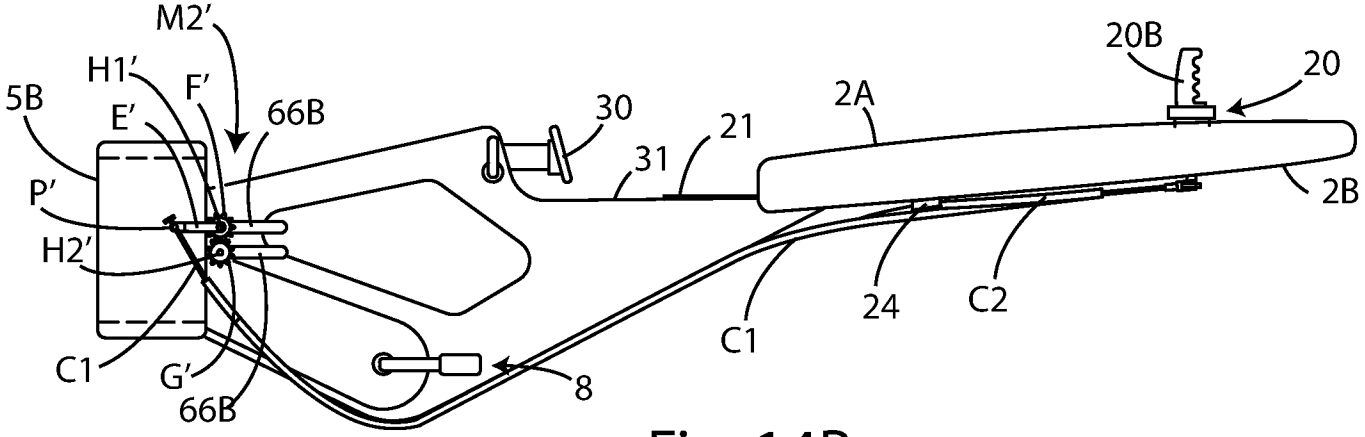

FIG. 11 shows a fourth embodiment of the vehicle for use in water.

Differently from the first embodiment, said 1 vehicle comprises a casing 40, arranged inside the through opening 33, fitted with an aperture sealingly closed by a door 40A.

In particular, said casing 40 is shaped so as not to project with respect to said through opening 33 and inside thereof it comprises:

- a (not shown) electric motor, connected to both screw propellers 4A, 4B,
- a (not shown) detection sensor for detecting a user's push thrust,
- a (not shown) control unit for turning on/off said electric motor, connected to said detection sensor and to said electric motor, having an input for receiving a signal from said detection sensor, and an output for sending a turn-on/off signal to said electric motor.

Inside the same casing power means (not shown) is arranged, like, for example a battery, for powering said motor, said control unit and said detection sensor.

The vehicle is fitted with a (not shown) turn-on/off button for activating said control unit, said detection sensor and said electric motor, so that when the detection sensor detects the push thrust, the control unit turns-on the electric motor.

The detection sensor can detect the push thrust of a user or by the rotation of the pedals or by the effort given on the pedals by the user.

FIGS. 11-14 show a fifth embodiment of the vehicle for use in water.

Differently from the first embodiment, the vehicle 1 alternatively to each rudder comprises a pair of fins.

In other words, the vehicle 1 comprises a first pair of fins 66A and a second pair of fins 66B, each one thereof is associated to a respective screw propeller 4A and 4B.

The fins of each pair of fins are movable from an opening position, wherein the fins are substantially horizontal, that is substantially parallel to a support bracket, allowing the passage of water through the respective screw propeller, to a closing position, wherein the fins are substantially vertical, that is substantially orthogonal to support bracket, by preventing the water passage through the respective screw propeller, and viceversa.

The motion system of the pairs of fins comprises a first mechanism M1' for moving said first pair of fins 66A, and a second mechanism M2' for moving said second pair of fins 66B.

The first cable C1 connects the first control lever 20A with the second mechanism M2' for moving said second pair of fins 66B and the second cable C2 connects the second control lever 20B with the first mechanism M1' for moving said first pair of fins 66A.

Each motion mechanism for the fins of a pair of fins 66A,66B comprises a first gear wheel F,F', integral to a first rotation shaft H1,H1', revolvingly assembled on a support bracket S1,S2, a second gear wheel G,G', engaged with said first gear wheel, wherein said second gear wheel G, G' is integral to a second rotation shaft H2,H2', revolvingly assembled on a support bracket S1,S2 too.

Each motion mechanism further comprises a lever E,E' having a first end integral to the first rotation shaft H1, H1' of the first gear wheel F,F' and a second end coupled to a detent P,P', coupled to a respective cable C2,C1 so that, when a control lever 20A, 20B is rotated, the lever E,E' is put into rotation by the respective cable C2, C1, (by means of the detent P,P') and the gear wheels of a pair of gear wheels rotate in opposite directions, by bringing the fins of a pair of fins in closing position.

In particular, the first mechanism M1' for moving said first pair of fins 66A is actuated by the second cable C2 associated to the second control lever 20B, as said second cable C2 is connected to the pin P of the first mechanism M1'.

The second mechanism M2' for moving said second pair of fins 66B is actuated by the first cable C1, associated to the first control lever 20A, as said first cable C1 is connected to the pin P' of the second mechanism M2'.

Furthermore, said first mechanism M1' comprises a first pair of bearings K1, arranged on said first rotation shaft H1 near a respective end of said first rotation shaft H1 and a second pair of bearings K2, arranged on said second rotation shaft H2.

The second mechanism M2' comprises a first pair of bearings K1', each one thereof is arranged near a respective end of the first rotation shaft H1' and a second pair of bearings K2', each one thereof is arranged near a respective end of the second rotation shaft H2'.

In the example which is described, the cables C1, C2 and the pulley 24 in order to avoid the interference between said cables are external to the vehicle. However, even though it is not shown in the figures, said cables and/or pulley 24 can be inside the vehicle 1.

Figure 15:
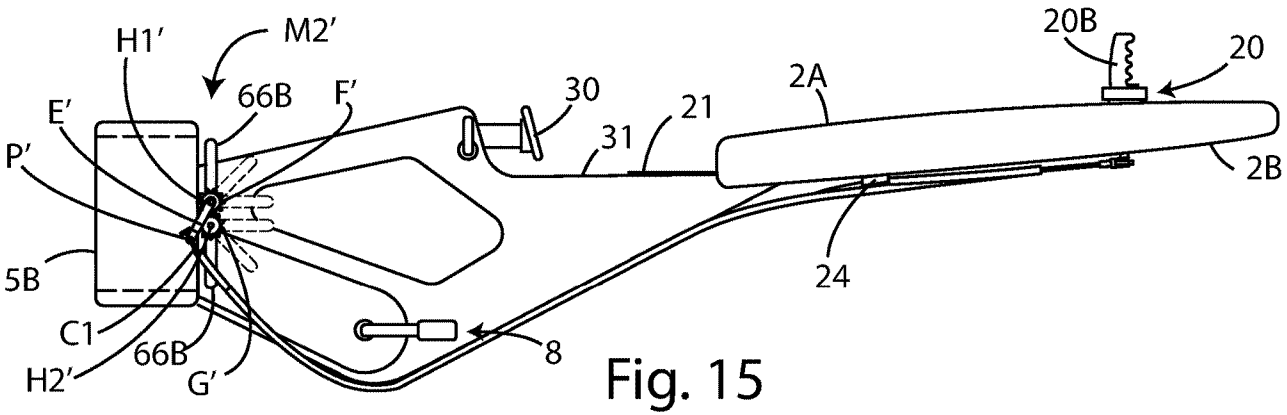
FIG. 15 shows the kinematic mechanism by means of which the fins of a pair of fins, associated to a screw propeller of the vehicle, are brought in closing position.
Figure 16:
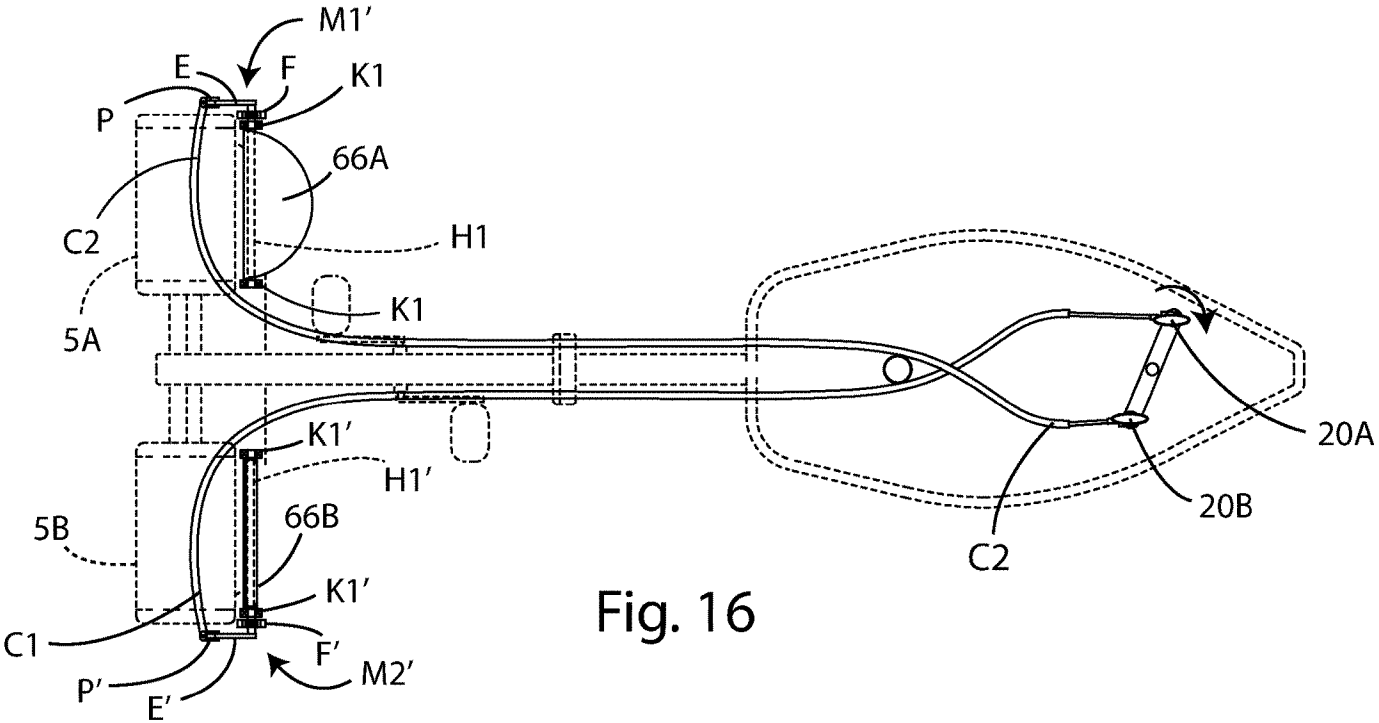
FIG. 16 shows a top view of the vehicle when the fins of a pair of fins are in closing position so that the vehicle turns on the right.

By particularly referring to FIGS. 15 and 16, the case is shown wherein the vehicle turns on the right.

When the first control lever 20A is rotated by a (not shown) user, the first cable C1 acts (by means of the lever E' and the pair of gear wheels F',G') on the second pair of fins 66B, associated to the second screw propeller 4B, so that both fins of said second pair of fins pass in closing position, by preventing the passage of a water quantity through said second screw propeller 4B.

The fins of the first pair of fins 66A, instead, remain in opening position, so that the first screw propeller 4A guarantees the push to the vehicle. The two cables C1,C2 are independent therebetween. Therefore, when the first control lever 20A is rotated by a user, the first cable C1 associated thereto acts on the second pair of fins 66B by means of the respective motion mechanism, and viceversa.

For each above-described embodiment, the floating board can be made for example with materials typically used in the productions of usual surf boards, such as for example epoxy resins or the like.

Furthermore, the cables are coated with a sheath. However it is not necessary that they are coated with a sheath. Alternatively to the cables, it is possible using any connecting element which is useful to connect the steering means to the motion system of the rudders or of the pairs of fins.

Furthermore, in the above-described embodiments, the vehicle comprises two screw propellers. However, it is possible providing any number of screw propellers.

Advantageously, the vehicle for use in water, subject of the invention, is light, hydrodynamic and it allows the user to turn with simplicity.

Another advantage is given by the possibility, when needed, of decoupling the board from the tail component so as to reduce the encumbrance and facilitate the transportation of the vehicle.

The present invention has been so far described by way of illustration, but not with limitative purposes, according to preferred embodiments thereof, but it is to be meant that variations and/or modifications could be introduced by the persons skilled in the art without leaving for this reason the relative protective scope, as defined by the enclosed claims.

The invention claimed is:

1. A vehicle for use in water by a user, comprising:

a floating board, a tail component, coupled to said board, a first screw propeller and a second screw propeller, actuating means for actuating said screw propellers, configured to remain submerged when said vehicle is used and to be actuated by the user's feet, a first directing means and a second directing means for changing the direction of advancement of said vehicle, respectively associated to said first screw propeller and to said second screw propeller, a motion system for moving said first directing means and said second directing means, comprising a first motion mechanism, connected to said first directing means, for moving said first directing means, and a second motion mechanism, connected to said second directing means for moving said second directing means, a steering means, arranged on said board, and a connecting means configured for connecting said steering means to said motion system, where said connecting means comprises a first connecting element and a second connecting element, and in that said steering means comprises a first control lever, connected to said second motion mechanism for moving said second directing means by said first connecting element, and a second control lever, connected to said first motion mechanism for moving said first directing means by said connecting element.

2. The vehicle according to claim 1, characterized in that said first directing means comprises a first pair of fins and said second directing means comprises a second pair of fins; the fins of each pair of fins being movable from an opening position, wherein the fins of one pair of fins are substantially in a horizontal position and allow the passage of water through the respective screw propeller, to a closing position, wherein the fins of one pair of fins are substantially in a vertical position and prevent the passage of water through the respective screw propeller, and viceversa.

3. The vehicle according to claim 1, characterized in that said first motion mechanism and said second motion mechanism respectively comprise:

a first gear wheel, integral to a first rotation shaft, a second gear wheel, integral to a second rotation shaft, said second gear wheel being engaged with said first gear wheel, a lever having a first end integral to said first rotation shaft of said first gear wheel and a second end coupled to a detent; said detent being coupled to the connecting element, so that, when the control lever is rotated, the lever is rotated by said connecting element by means of said detent and the gear wheels of a pair of gear wheels rotate in opposite directions, so that the fins of one pair of fins go from the opening position to the closing position or viceversa.

4. The vehicle according to claim 1, characterized in that said first directing means comprises a first rudder and said second directing means comprises a second rudder; each rudder being steerable relative to the direction of advancement of said vehicle.

5. The vehicle according to claim 4, characterized in that said motion system comprises a connecting kinematic mechanism for connecting said first motion mechanism to said second motion mechanism so that:

when the first motion mechanism moves said first rudder in a first direction, said second motion mechanism is set in motion by said first motion mechanism, by means of said connecting kinematic mechanism, and moves said second rudder in the same direction of said first rudder, and when the second motion mechanism moves said second rudder in a second direction, opposite to said first direction, said first motion mechanism is set in motion by said second motion mechanism, by means of said connecting kinematic mechanism, and moves said first rudder in the same direction of said second rudder.

6. The vehicle according to claim 5, characterized in that the tail component comprises a first support bracket for supporting the first screw propeller and a second support bracket for supporting the second screw propeller, and in that said first motion mechanism and said second motion mechanism respectively comprise:

a first element, thereto the connecting element is coupled, said first element being rotatably pivoted on a first plate by means of a first pin, and wherein said first plate is coupled to said first support bracket, a second element rotatably pivoted on a support bracket by a second pin, a first connecting rod for rotatably connecting said first element to said second element so that, when said first element rotates in a direction, the second element rotates in the same direction of said first element by means of said first connecting rod, a second connecting rod for rotatably connecting said second element to a bracket integral to a rudder so that, when said second element rotates, said rudder rotates by a predetermined angle in the same direction of said first element, and in that said connecting kinematic mechanism comprises:

a third element rotatably pivoted on the first plate of the first motion mechanism by a first pin, a fourth element rotatably pivoted on the first plate of the second motion mechanism by a second pin, a third connecting rod for rotatably connecting said first element of said connecting kinematic mechanism to said first element of said first motion mechanism, a fourth connecting rod for rotatably connecting said second element of said connecting kinematic mechanism to said first element of said second motion mechanism, a fifth connecting rod for rotatably connecting said first element of said connecting kinematic mechanism to said second element of said connecting kinematic mechanism.

7. The vehicle according to claim 1, characterized in that it comprises a pulley fitted with at least one groove for housing a portion of a respective connecting element for preventing the two connecting elements from interfering with each other.

8. The vehicle according to claim 1, characterized in that said board is removably coupled with said tail component.

9. The vehicle according to claim 8, characterized in that said board has at least one through hole for allowing the passage of at least one coupling element and comprises a first elongated portion fitted with one or more holes, wherein said first elongated portion is coupled to said board so as to project with respect thereto, said at least one through hole overlapping a hole of said first elongated portion, and in that said tail component comprises a second elongated portion fitted with a plurality of holes, wherein said first elongated portion of said board and said second elongated portion of said tail component are sized and configured to overlap at least partially, so that one or more holes of said first elongated portion of said board overlap respectively to one or more holes of said second elongated portion of said tail component so that said at least one coupling element couples said board to said tail component.

10. The vehicle according to claim 1, characterized in that said board comprises a pair of stabilizing elements so as to give greater stability to said vehicle in water; each one of said stabilizing elements being obtained in said board and movable from a first position, wherein it is inside said board, and a second position, wherein it is external to said board and projects sideways relative thereto, and viceversa.

11. The vehicle according to claim 1, characterized in that said board comprises a first surface, whereon a user rests at least partially, and a second surface, opposite to said first surface, and in that it is fitted with a floating element to give greater buoyancy to said board, arranged on said second surface.

12. The vehicle according to claim 1, characterized in that said tail component is fitted with a through opening.

13. The vehicle according to claim 12, characterized in that said vehicle comprises a casing, arranged inside said through opening and shaped so as not to project with respect to said tail component, said casing being fitted with an aperture hermetically sealed by a door, in that said casing comprises inside thereof:

an electric motor, connected to the screw propellers, a detection sensor for detecting a user's push thrust, a control unit for turning on/off said electric motor, connected to said detection sensor and to said electric motor, said control unit having an input for receiving a signal from said detection sensor, and an output for sending a turn-on/off signal to said electric motor, a power means for powering said electric motor, said control unit and said detection sensor, and in that said vehicle is fitted with a turn-on/off button for activating said control unit, said detection sensor and said electric motor, so that when the detection sensor detects the push thrust, the control unit turns-on the electric motor.

14. The vehicle according to claim 13, characterized in that said power means is a battery.

* * * * *